US011130039B1

(12) United States Patent
Mendelsohn

(10) Patent No.: US 11,130,039 B1
(45) Date of Patent: Sep. 28, 2021

(54) WHEELCHAIR ACCESSIBLE FITNESS EQUIPMENT

(71) Applicant: Sam Mendelsohn, Santa Ana, CA (US)

(72) Inventor: Sam Mendelsohn, Santa Ana, CA (US)

( * ) Notice: Subject to any disclaimer, the term of this patent is extended or adjusted under 35 U.S.C. 154(b) by 60 days.

(21) Appl. No.: 16/788,884

(22) Filed: Feb. 12, 2020

Related U.S. Application Data

(63) Continuation of application No. 15/907,058, filed on Feb. 27, 2018, now abandoned.

(51) Int. Cl.

| | |
|---|---|
| ***A63B 71/00*** | (2006.01) |
| ***A63B 23/035*** | (2006.01) |
| ***A63B 21/00*** | (2006.01) |
| ***A63B 21/008*** | (2006.01) |

(52) U.S. Cl.
CPC ..... *A63B 71/0009* (2013.01); *A63B 21/0087* (2013.01); *A63B 21/4035* (2015.10); *A63B 21/4047* (2015.10); *A63B 23/03525* (2013.01); *A63B 2071/0018* (2013.01)

(58) Field of Classification Search
CPC ..... A63B 21/0087; A63B 21/4035; A63B 21/4047; A63B 71/0009–2071/0018; A63B 23/03525
See application file for complete search history.

(56) References Cited

U.S. PATENT DOCUMENTS

D230,613 S * 3/1974 Coker et al. ..... D21/673
3,912,265 A * 10/1975 Muir ..... A63B 21/4047 482/113
4,478,412 A * 10/1984 Muir ..... A63B 21/0083 137/614.17
4,880,230 A 11/1989 Cook
4,911,436 A 3/1990 Lighter
5,362,297 A * 11/1994 Muir ..... A63B 21/023 482/112
D394,482 S * 5/1998 Colonello ..... D21/673
6,290,630 B1 * 9/2001 Boland ..... A63B 21/0083 482/112
9,079,069 B1 7/2015 Mendelsohn
2011/0201482 A1 * 8/2011 Huang ..... A63B 24/0087 482/112
2016/0271437 A1 * 9/2016 Scott ..... A63B 21/0083

OTHER PUBLICATIONS www.playworldsystems.com/products/tricep_strength_ stability_ exercises_accessible, Author: Unknown; Date: Unknown.
www.greatoutdoorgym.ca/wheelchairequipment.html; Author: Unknown; Date: Unknown.

* cited by examiner

*Primary Examiner* — Jennifer Robertson
(74) *Attorney, Agent, or Firm* — Eric Karich; Karich & Associates

(57) ABSTRACT

Fitness equipment is installed in or on a ground surface for enabling an exercise by a user in a wheelchair. The fitness equipment includes a base operably installed adjacent a wheelchair space. The equipment includes an upwardly extending post the base to an upper end, and includes a front facing surface which faces the wheelchair space, and an opposed rear facing surface. A pneumatic cylinder has a first pivot connected to the rear facing surface, and a second pivot attached to a cam, the cam being pivotally attached to a pivot mount of the upwardly extending post. A U-shaped arm assembly that extends from the cam, around the upwardly extending post, to a pair of laterally spaced ends positioned on either side of the wheelchair space without extending into the wheelchair space.

2 Claims, 3 Drawing Sheets

WHEELCHAIR ACCESSIBLE FITNESS EQUIPMENT

CROSS-REFERENCE TO RELATED APPLICATIONS

This application for a utility patent is a continuation of a previously filed utility patent, currently pending, having the application Ser. No. 15/907,058, filed Feb. 27, 2018.

BACKGROUND OF THE INVENTION

Field of the Invention

This invention relates generally to fitness equipment, and more particularly to fitness equipment that is adapted for use by people in wheelchairs.

Description of Related Art

Various forms of fitness equipment, used in gyms, recreational rooms, and outdoor parks, are known in the prior art. However, prior art devices typically cater to people who are not handicapped, and these devices are not typically usable by people in wheelchairs, for several reasons. For one, the limitation of getting into the proper position while in a wheelchair, due to obstructions by the seat of the fitness equipment, or other hardware of the fitness equipment. Another limitation is that machines for non-wheelchair users are often designed for users to perform exercises in a standing position. A user in a wheelchair is therefore unable to reach the bars or handles, and even if they were able to would most likely not be able to perform the exercise properly.

Applicant's prior invention, disclosed in Mendelsohn, U.S. Pat. No. 9,079,069, teaches fitness equipment which enables exercise by a user in a wheelchair. The fitness equipment includes a rigid frame supported by the base such that the rigid frame does not extend into the wheelchair space. The fitness equipment also has a weight stack positioned adjacent the rigid frame and attached to an arm assembly for providing resistance to movement of the arm assembly, so that the user may perform an exercise activity using the arm assembly while sitting in the wheelchair.

While the prior art teaches some components of the present invention, and Applicant's prior patent in particular teaches many similar structure and methods, the prior art does not teach the novel elements of the present invention, as described in greater detail below.

SUMMARY OF THE INVENTION

The present invention teaches certain benefits in construction and use which give rise to the objectives described below.

The present invention provides fitness equipment installed in or on a ground surface for enabling an exercise by a user in a wheelchair positioned in a wheelchair space that is suitable for receiving the user in the wheelchair. The fitness equipment includes a base operably installed in or on the ground surface adjacent the wheelchair space; an upwardly extending post that extends from a lower end which is attached to the base, to an upper end, and includes a front facing surface which faces the wheelchair space, and an opposed rear facing surface which faces away from the wheelchair space; a pneumatic cylinder having a first end with a first pivot, and a second end with a second pivot, and wherein the first end of the pneumatic cylinder is connected to the rear facing surface of the via the first pivot, and wherein the second end of the pneumatic cylinder is connected to a cam via the second pivot, the cam being pivotally attached to a pivot mount of the upwardly extending post; and a generally U-shaped arm assembly that extends from the cam, around the upwardly extending post, to a pair of laterally spaced ends positioned on either side of the wheelchair space without extending into the wheelchair space.

BRIEF DESCRIPTION OF THE DRAWING

The accompanying drawings illustrate the present invention. In such drawings.

DETAILED DESCRIPTION OF THE INVENTION

The above-described drawing figures illustrate the invention, fitness equipment which is preferably constructed for installation and use outdoors, and is particularly adapted to be wheelchair accessible.

Figure 1:
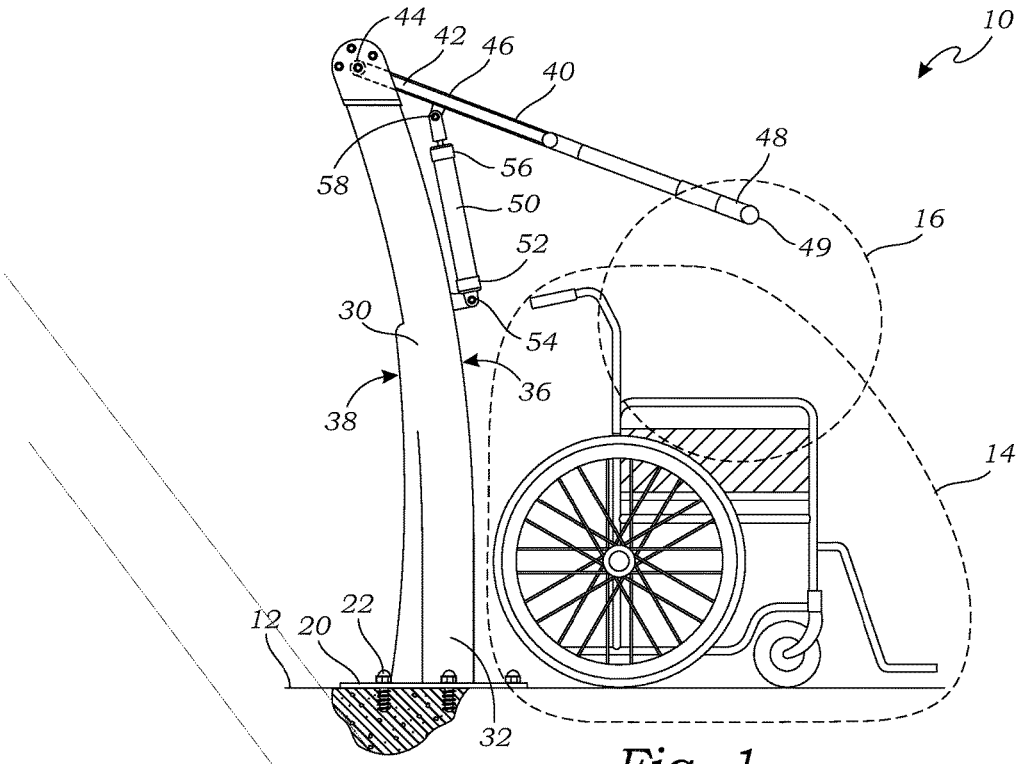
FIG. 1 is a side elevational view of a first embodiment of fitness equipment according to the present invention, wherein the fitness equipment is in the nature of a shoulder press.
Figure 2:
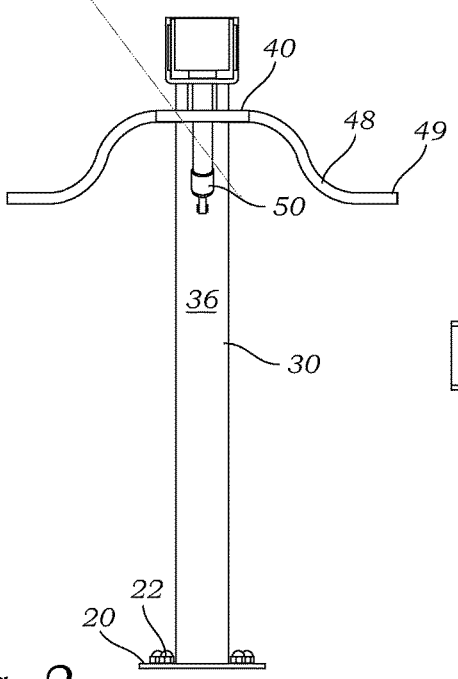
FIG. 2 is a front elevational view thereof.

FIG. 1 is a side elevational view of a first embodiment of the fitness equipment 10 according to the present invention, wherein the fitness equipment 10 is in the nature of a shoulder press. FIG. 2 is a front elevational view thereof, and FIG. 3 is a top plan view thereof.

Figure 3:
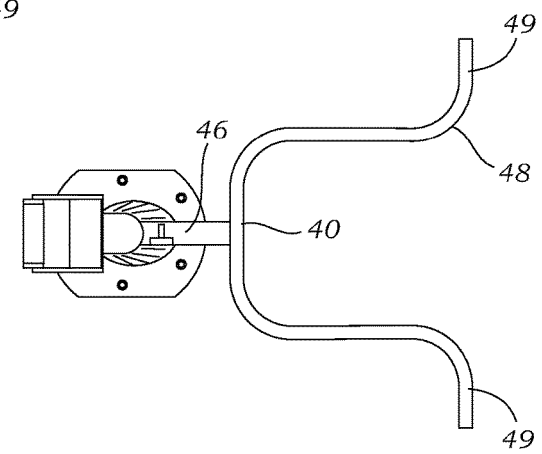
FIG. 3 is a top plan view thereof.

As illustrated in FIGS. 1-3, in this embodiment the fitness equipment 10 includes the base 20, which in this embodiment may be in the form of an outwardly extending flange. A plurality of bolts 22 extend through the outwardly extending flange 20 and into the ground surface 12. In alternative embodiments, the base 20 may be a suitable solid structure that is set into the ground surface 12, a mobile mounting system, not illustrated, or any other structure for mounting or positioning the fitness equipment 10 consistent with the present invention.

As shown in FIGS. 1-3, a rigid frame 30 extends upwardly from the ground surface 12 adjacent the wheelchair space 14, but does not extend into the wheelchair space 14, thereby leaving room adjacent the base 20 and the rigid frame 30 to park the wheelchair. In this embodiment, the rigid frame 30 is in the form of an upwardly extending post that extends from a lower end 32 which is attached to the base 20, to an upper end 34. In this embodiment, the upwardly extending post extends 50-70 inches. The upwardly extending post 30 of this embodiment includes a front facing surface 36 and a rear facing surface 38. In this embodiment, the upwardly extending post 30 arcs backwardly towards the rear facing surface 38 and away from the wheelchair space 12, so that the front facing surface 36 is convex while the rear facing surface 38 is concave.

As shown in FIGS. 1-3, the rigid frame 30 supports an arm assembly 40 which may be positioned in or adjacent to a user space 16 above or around the wheelchair space 14, where the arm assembly 40 may be reached by a user sitting in the wheelchair. In this manner, the arm assembly 40 does not extend into the wheelchair space 14 (blocking the wheelchair), but does extend above it or adjacent to it for use by the user in the wheelchair for performing an exercise activity. Various alternative embodiments of this general construction are illustrated in the additional drawings and described in greater detail below.

The arm assembly 40 extends into or adjacent the user space 16, above the wheelchair space 14, so that it may be readily grasped by the user for performing the exercises, without entering into the wheelchair space 14 (and blocking the proper positioning of the wheelchair within the wheelchair space 14). In this embodiment, the arm assembly 40 includes a proximal end 42 that is pivotally mounted on the upper end 34 of the upwardly extending post 30 with an arm pivot 44. The arm assembly 40 further includes a middle portion 46 and a distal end 48, which may include a gripping structure 49, in this case a pair of laterally spaced hand gripping areas. The arm assembly 40 is actuated by the handicapped user by pushing the arms of the arm assembly 40 upwardly.

As shown in FIGS. 1-3, the fitness equipment 10 further includes a pneumatic cylinder 50 having a first end 52 with a first pivot 54, and a second end 56 with a second pivot 58. The pneumatic cylinder 50 is connected to the rigid frame 30 via the first pivot 54, and attached to the arm assembly 40 via the second pivot 58, so that the motion of arm assembly 40 is resisted by the pneumatic cylinder 50. The pneumatic cylinder 50 may be any form of pneumatic mechanism (e.g., air cylinder, or any form of equivalent device) to resist movement of the arm assembly 40. One exemplar of a similar pneumatic cylinder 50 is shown in Cook, U.S. Pat. No. 4,880,230, which is hereby incorporated by reference in full. However, those skilled in the art may devise a wide range of similar pneumatic cylinders that are suitable for the present invention.

In the embodiment of FIGS. 1-3, the pneumatic cylinder 50 is mounted on the front surface 36 of the rigid frame 30 via the first pivot 54. In this preferred embodiment, the pneumatic cylinder is positioned directly beneath the arm assembly 40, and attached to the middle portion 46 of the arm assembly 40. With the rearward curvature of the upwardly extending post 30, the pneumatic cylinder 50 is able to properly connect with the arm assembly 40 without interfering with the positioning of the wheelchair, or threatening to bump against the user while exercising. In this embodiment, the arm assembly 40 is pivotally mounted on the upper end 34 of the upwardly extending post 30 with an arm pivot 44.

Figure 4:
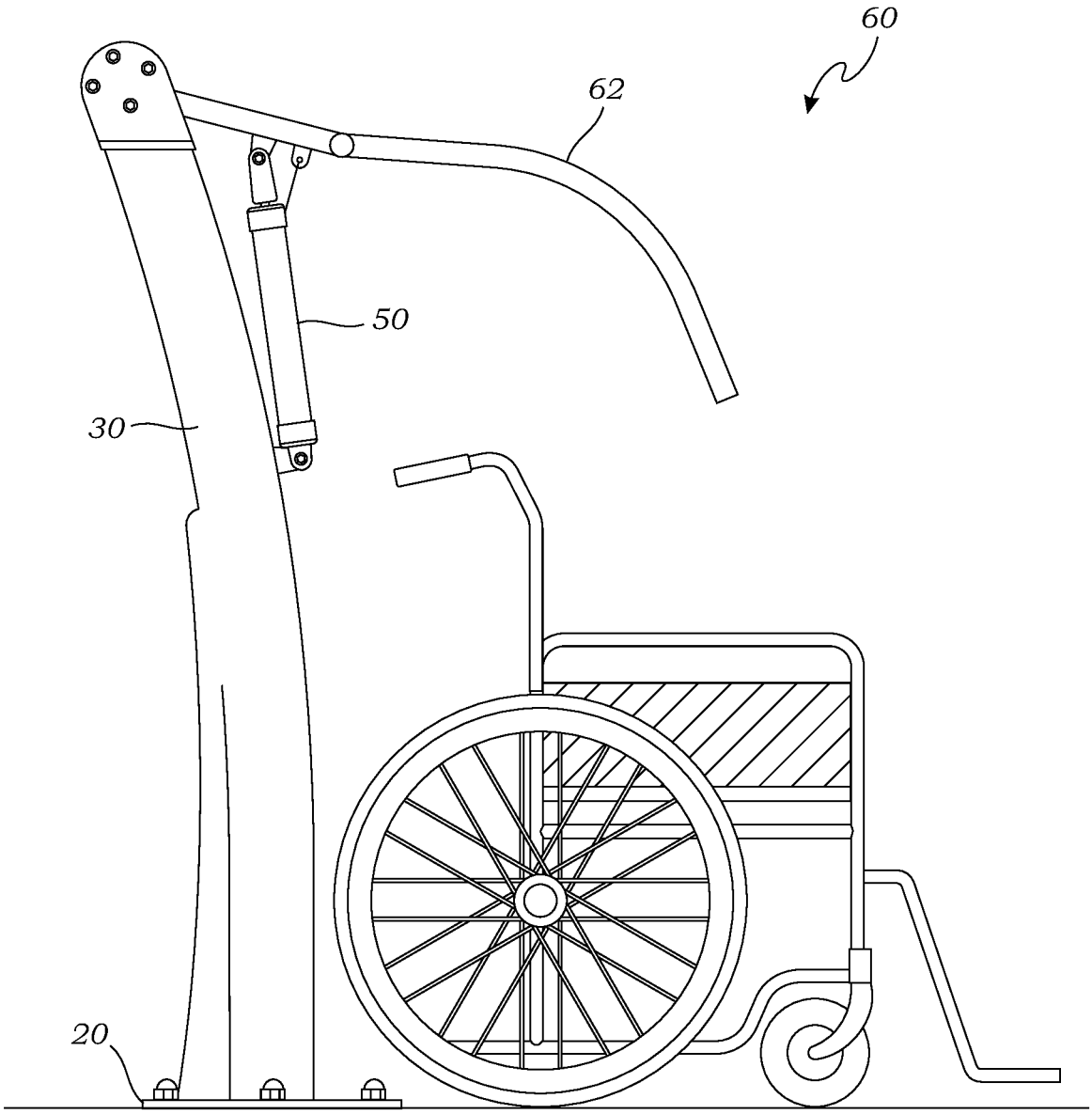
FIG. 4 is a side elevational view of a second embodiment of fitness equipment according to the present invention, wherein the fitness equipment is in the nature of a vertical press.

FIG. 4 is a side elevational view of a second embodiment of fitness equipment 60 according to the present invention, wherein the fitness equipment 60 is in the nature of a vertical press. As illustrated in FIG. 4, the fitness equipment 60 of this embodiment is generally similar to the previous embodiment; however, in this embodiment, an arm assembly 62 is shaped and positioned for performing vertical press exercises.

Figure 5:
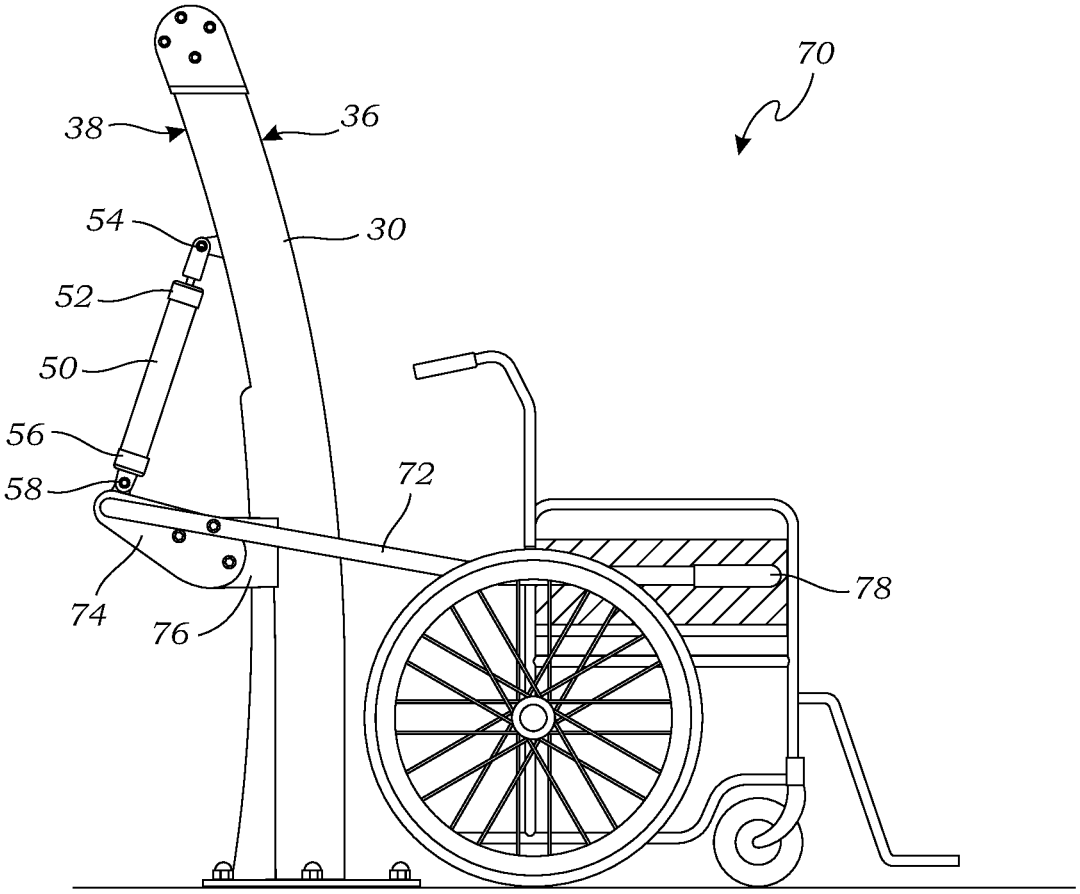
FIG. 5 is a side elevational view of a third embodiment of fitness equipment according to the present invention, wherein the fitness equipment is in the nature of a triceps press down.
Figure 6:
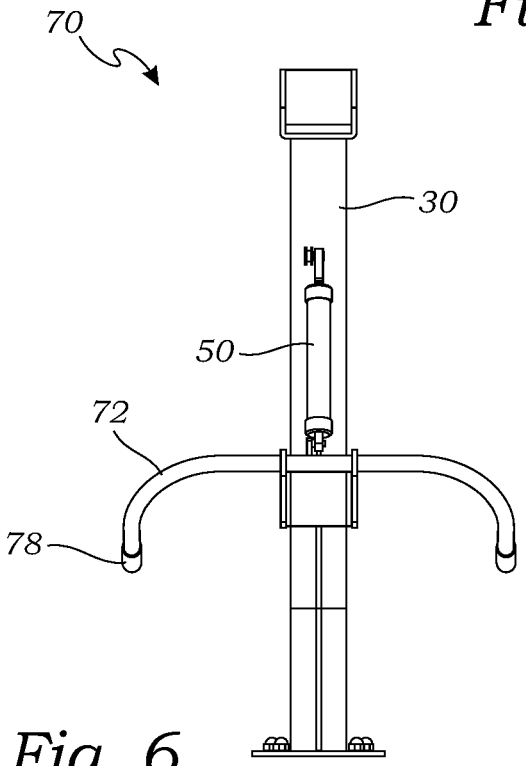
FIG. 6 is a rear elevational view thereof.
Figure 7:
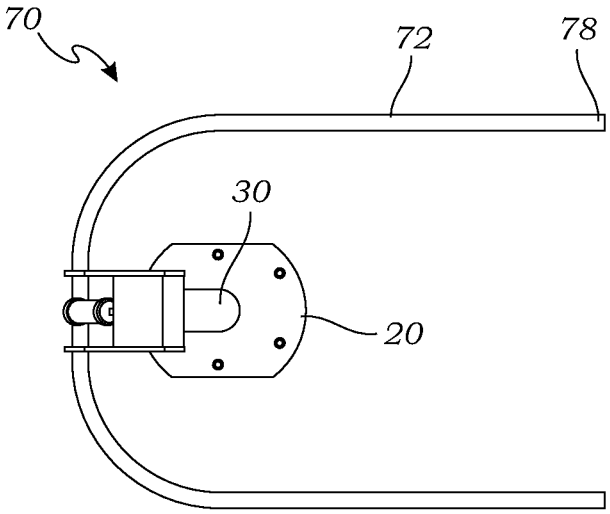
FIG. 7 is a top plan view thereof.

FIG. 5 is a side elevational view of a third embodiment of fitness equipment 70 according to the present invention, wherein the fitness equipment 70 is in the nature of a triceps press-down machine. FIG. 6 is a rear elevational view thereof; and FIG. 7 is a top plan view thereof. As illustrated in FIGS. 5-7, in this embodiment the pneumatic cylinder 50 is mounted on the rear surface 38 of the rigid frame 30 via the first pivot 54. In this embodiment, the pneumatic cylinder 50 is positioned above the arm assembly 72, and the second pivot 58 is attached to a cam 74, which is pivotally attached to a pivot mount 76 of the rigid frame 30. In this embodiment, the arm assembly 72 is generally U-shaped and is mounted to the cam 74 and extends to a pair of laterally spaced ends 78, which are adapted for the user to grip while performing the exercise.

While several particular forms of exercise machines are illustrated herein, the invention is intended to include any combination of exercise configurations which may be devised by those skilled in the art using the teachings of the present invention. Furthermore, any number of users may be accommodated, whether a single unit for a single user, a dual unit, or even accommodating three or more, in larger pieces of equipment.

Also, the term wheelchair is defined to include not only wheelchairs of the typical sort where the user propels themselves under their own power, but also other chairs or other personal conveyance devices such as electric wheelchairs or scooters for elderly persons. This also includes specialized wheelchairs which may have significantly different shapes than the standard wheelchair, such as racing wheelchairs, etc.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. Fitness equipment installed in or on a ground surface for enabling exercise by a user in a wheelchair positioned in a wheelchair space, the fitness equipment comprising:

a base operably installed in or on the ground surface adjacent the wheelchair space;

an upwardly extending post that extends from a lower end which is attached to the base, to an upper end, and includes a front facing surface which faces the wheelchair space, and an opposed rear facing surface which faces away from the wheelchair space, wherein the upwardly extending post arcs backwardly toward the rear facing surface and away from the wheelchair space so that the front facing surface is convex while the rear facing surface is concave;

a pneumatic cylinder having a first end with a first pivot, and a second end with a second pivot, and wherein the first end of the pneumatic cylinder is connected to the rear facing surface of the upwardly extending post via the first pivot, and wherein the second end of the pneumatic cylinder is connected to a cam via the second pivot, the cam being pivotally connected with a pivot mount of the upwardly extending post;

wherein the first pivot is attached to the upwardly extending post closer to the upper end than the base, and wherein the pivot mount of the cam is attached to the upwardly extending post closer to the base than the first pivot, so that the pneumatic cylinder extends from the first pivot downwardly to the cam; and a generally U-shaped arm assembly that extends from the cam, around the upwardly extending post, to a pair of laterally spaced ends positioned on either side of the wheelchair space without extending into the wheelchair space.

2. Fitness equipment installed in or on a ground surface for enabling exercise by a user in a wheelchair positioned in a wheelchair space, the fitness equipment comprising:

a base operably installed in or on the ground surface adjacent the wheelchair space;

a rigid frame consisting of an upwardly extending post that extends from a lower end which is attached to the base, to an upper end, and includes a front facing surface which faces the wheelchair space, and an opposed rear facing surface which faces away from the wheelchair space, wherein the upwardly extending post arcs backwardly toward the rear facing surface and away from the wheelchair space so that the front facing surface is convex while the rear facing surface is concave;

a pneumatic cylinder having a first end with a first pivot, and a second end with a second pivot, and wherein the first end of the pneumatic cylinder is connected to the rear facing surface of the upwardly extending post via the first pivot, and wherein the second end of the pneumatic cylinder is connected to a cam via the second pivot, the cam being pivotally connected with a pivot mount of the upwardly extending post;

wherein the first pivot is attached to the upwardly extending post closer to the upper end than the base, and wherein the pivot mount of the cam is attached to the upwardly extending post closer to the base than the first pivot, so that the pneumatic cylinder extends from the first pivot downwardly to the cam; and a generally U-shaped arm assembly that extends from the cam, around the upwardly extending post, to a pair of laterally spaced ends positioned on either side of the wheelchair space without extending into the wheelchair space.

* * * * *